US006289838B2

(12) United States Patent
Dust

(10) Patent No.: US 6,289,838 B2
(45) Date of Patent: Sep. 18, 2001

(54) BOAT

(75) Inventor: Norman Dust, St. Albert (CA)

(73) Assignee: Norcraft Consulting Services Inc., St Albert (CA)

( * ) Notice: Subject to any disclaimer, the term of this patent is extended or adjusted under 35 U.S.C. 154(b) by 0 days.

(21) Appl. No.: 09/746,357

(22) Filed: Dec. 22, 2000

Related U.S. Application Data

(63) Continuation-in-part of application No. 09/374,561, filed on Aug. 13, 1999, now abandoned.

(30) Foreign Application Priority Data

Aug. 28, 1998 (CA) ..... 2246031

(51) Int. Cl.[7] ..... B63B 35/71
(52) U.S. Cl. ..... 114/347; 114/292
(58) Field of Search ..... 114/347, 292, 114/61.1, 290; D12/302

(56) References Cited

U.S. PATENT DOCUMENTS

D. 392,241 * 3/1998 Kierstead, Jr. ..... D12/302
911,806 * 2/1909 Broward .
1,010,053 * 11/1911 Hunter .
3,469,549 * 9/1969 Rae ..... 114/288
5,038,696 * 8/1991 Athanasion ..... 114/56
5,042,416 * 8/1991 Arcouette ..... 114/347
6,112,692 * 9/2000 Lekhtman ..... 114/347

OTHER PUBLICATIONS

Canoe & Kayak, Jul. 1999, pp. 72,84,114,128,132 and an "Easy Rider" add in the same issue.*

* cited by examiner

*Primary Examiner*—Sherman Basinger
(74) *Attorney, Agent, or Firm*—Christensen O'Connor Johnson Kindness PLLC

(57) ABSTRACT

A boat includes a body having one or two paddling positions. The body is sufficiently narrow at the paddling positions to provide a comfortable paddling width. A bow extends forwardly and converges to become progressively narrower from the forward paddling position. A stern extends rearwardly and diverges to become progressively wider from the rearward paddling position. The stern has two hulls positioned rearward of the at least one paddling position and separated by a connecting surface. The connecting surface extends rearwardly and upwardly from the rearward paddling position to an upper remote end that is out of the water at the stern, thereby reducing drag.

5 Claims, 3 Drawing Sheets

BOAT

This is a continuation-in-part of Ser. No. 09/374,561 filed Aug. 13, 1999, now abandoned.

FIELD OF THE INVENTION

The present invention relates to a new design for a boat and, in particular, a boat that is intended to be manually paddled.

BACKGROUND OF THE INVENTION

Canoes and kayaks are light weight, easily manoeuvrable craft that are powered by paddling. They are well suited for recreational use. However, canoes and kayaks are known to have limited lateral stability.

SUMMARY OF THE INVENTION

What is required is a boat with enhanced stability that maintains the light weight, easy manoeuvring of canoes and kayaks, without adversely affecting paddling.

According to the present invention there is provided a boat which includes a body having at least one paddling position. The body is sufficiently narrow at the at least one paddling position to provide a comfortable paddling width. A bow extends forwardly and converges to become progressively narrower from the at least one paddling position. A stern extends rearwardly and diverges to become progressively wider from the at least one paddling position. The stern has two hulls positioned rearward of the at least one paddling position and separated by a connecting surface. The connecting surface extends rearwardly and upwardly from the at least one paddling position to an upper remote end that is out of the water at the stern, thereby reducing drag from the connecting surface.

The boat, as described above, can be made to resemble either a canoe or a kayak. However, it has substantially increased stability by virtue of the stance of the stern. This stability is obtained without widening the boat at the paddling position, which would make it more difficult to paddle.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
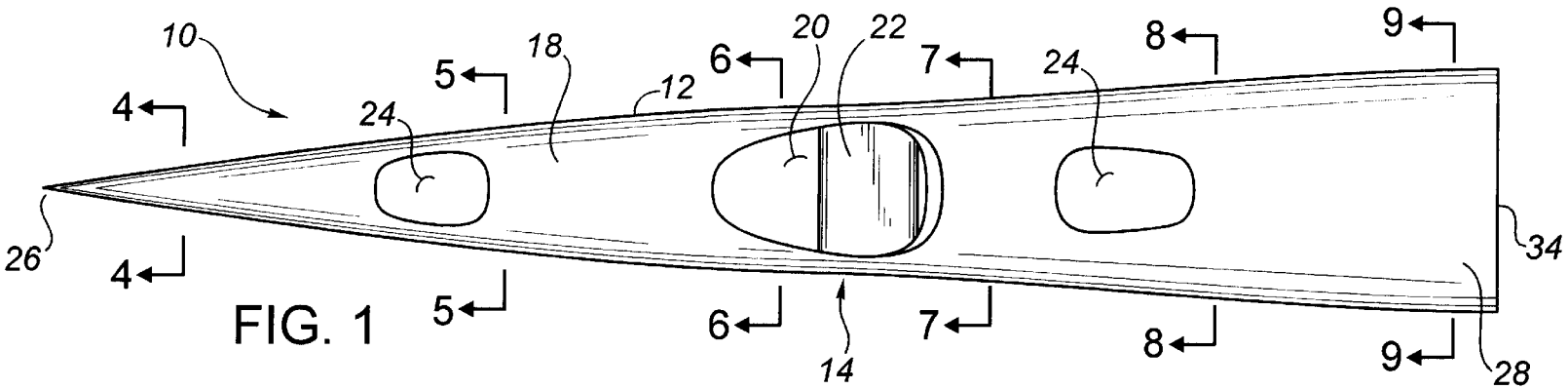
FIG. 1 is a top plan view of a boat with a single paddling position constructed in accordance with the teachings of the present invention.

A preferred embodiment of boat, generally identified by reference numeral 10, will hereinafter be described with reference to FIGS. 1 through 12.

Figure 2:
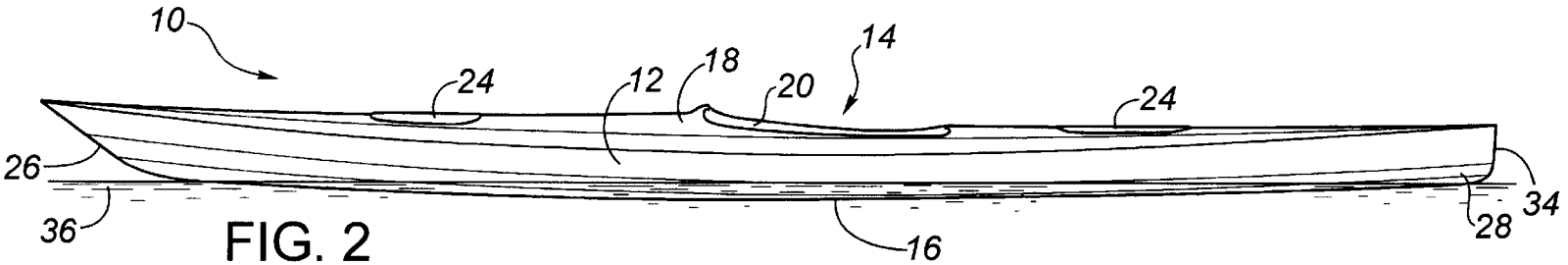
FIG. 2 is a side elevation view of the boat illustrated in FIG. 1.
Figure 12:
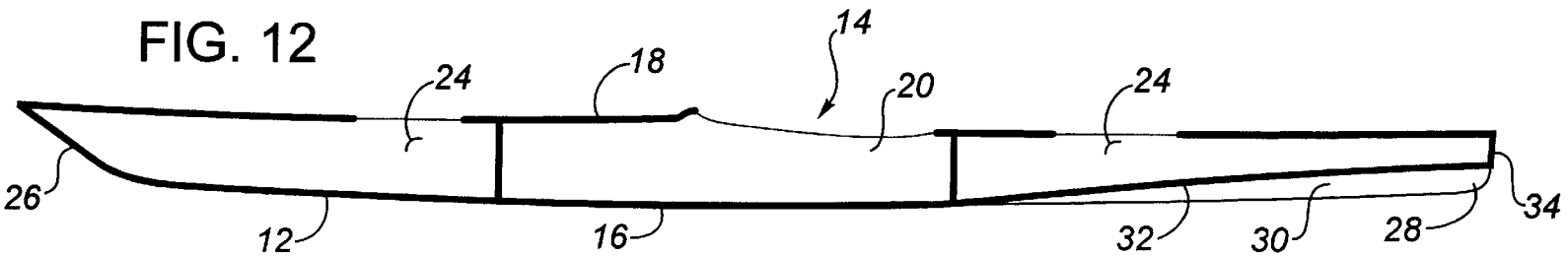
FIG. 12 is a side elevation view, in section, of the boat illustrated in FIG. 1.

Referring to FIG. 1, there is provided a boat 10 that includes a body 12 with a single paddling position, generally referenced by numeral 14. Boat 10 has a bottom 16 and a top surface covering 18. Paddling position 14 includes a single access opening 20 in top surface covering 18 with a seat 22 positioned thereunder. Referring to FIGS. 2 and 12, two storage openings 24 are also provided in top surface covering 18 to allow for placement of articles for storage within body 12.

Figure 3:
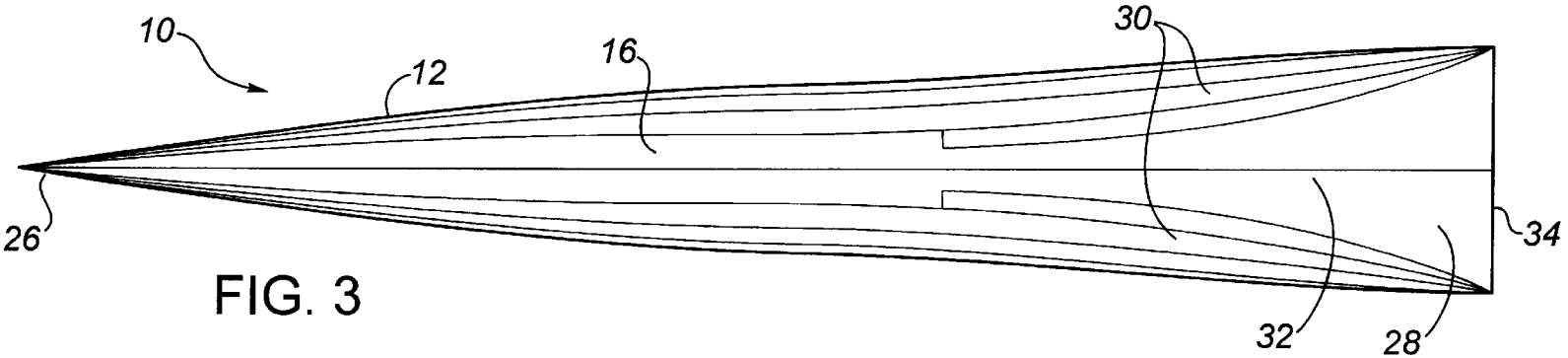
FIG. 3 is a bottom plan view of the boat illustrated in FIG. 1.
Figure 4:
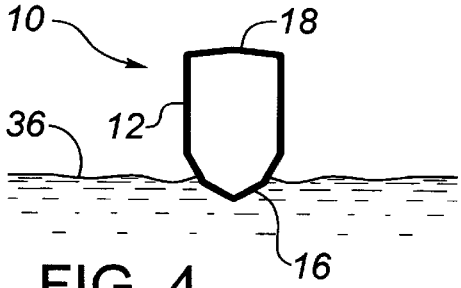
FIG. 4 is an end elevation view, in section, of the boat, taken along section lines 4—4 of FIG. 1.
Figure 7:
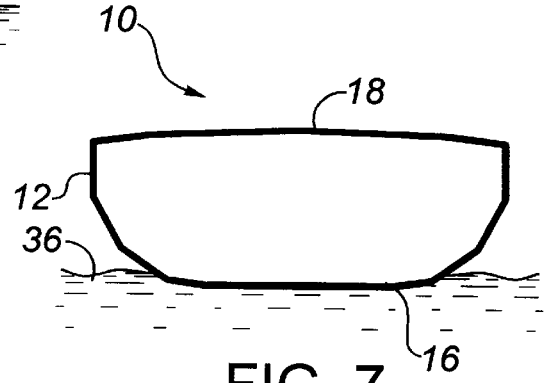
FIG. 7 is an end elevation view, in section, of the boat, taken along section lines 7—7 of FIG. 1.
Figure 5:
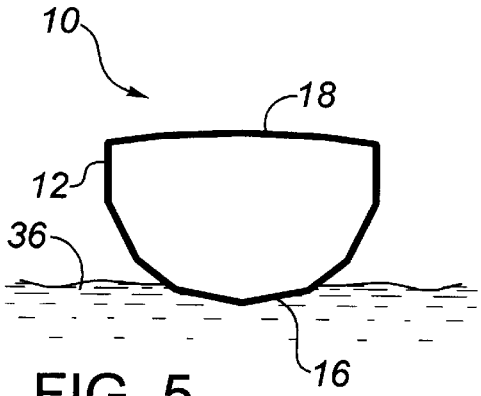
FIG. 5 is an end elevation view, in section, of the boat, taken along section lines 5—5 of FIG. 1.
Figure 8:
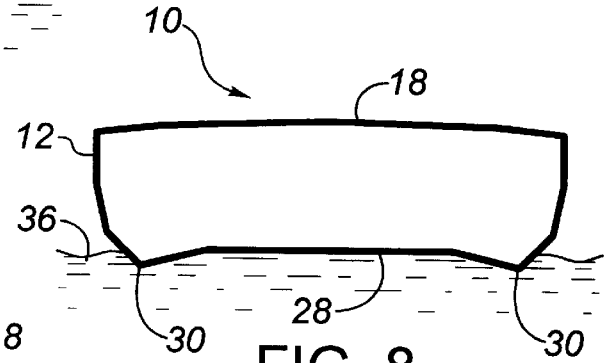
FIG. 8 is an end elevation view, in section, of the boat, taken along section lines 8—8 of FIG. 1.
Figure 6:
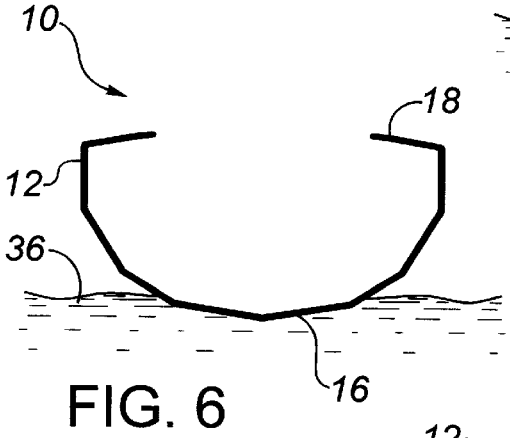
FIG. 6 is an end elevation view, in section, of the boat, taken along section lines 6—6 of FIG. 1.
Figure 9:
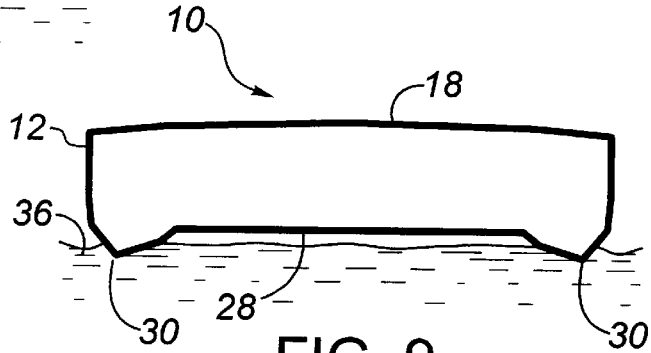
FIG. 9 is an end elevation view, in section, of the boat, taken along section lines 9—9 of FIG. 1.

Referring to FIG. 1, body 12 is sufficiently narrow at single paddling position 14 to provide a comfortable paddling width. A bow 26 extends forward and converges to become progressively narrower from single paddling position 14. A stern 28 extends rearward and diverges to become progressively wider from single paddling position 14, thereby increasing lateral stability. Referring to FIG. 3, stern 28 has two hulls 30 positioned rearward of paddling position 14. Hulls 30 are separated by a connecting surface 32. Referring to FIG. 12, connecting surface 32 extends rearward and upwardly from single paddling position 14 to an upper remote end 34 at stern 28. Referring to FIG. 9, at remote end 34, connecting surface 32 is positioned out of the water 36 to reduce drag. With reference to FIGS. 4 through 9, end elevation views are shown at intervals along hull 30, as along section lines 4—4, 5—5, 6—6, 7—7, 8—8, and 9—9 respectively of FIG. 1.

Figure 10:
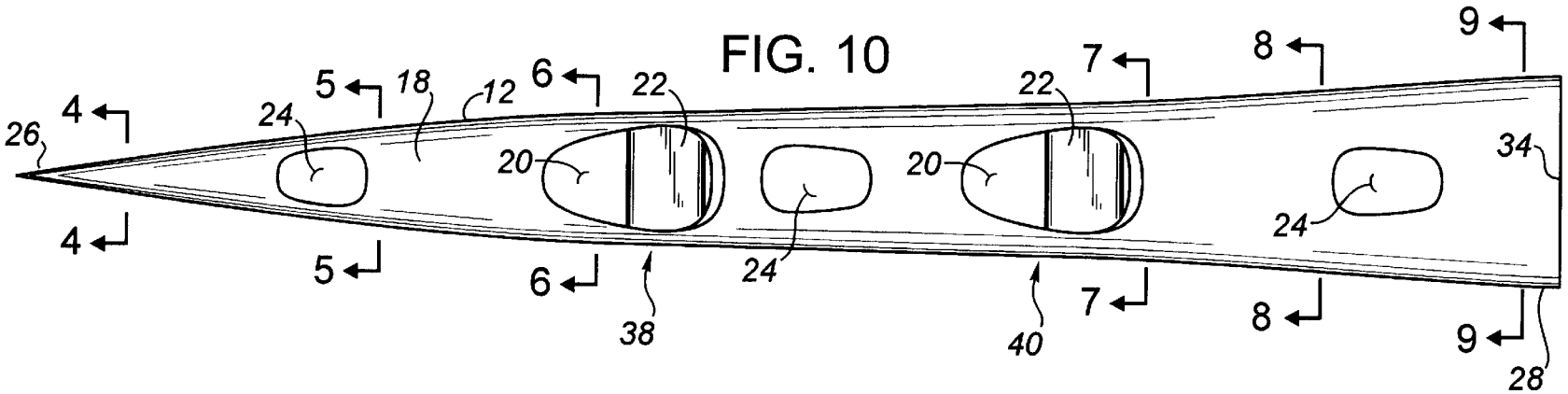
FIG. 10 is a top plan view of a boat with forward and rearward paddling positions constructed in accordance with the teachings of the present invention.
Figure 11:
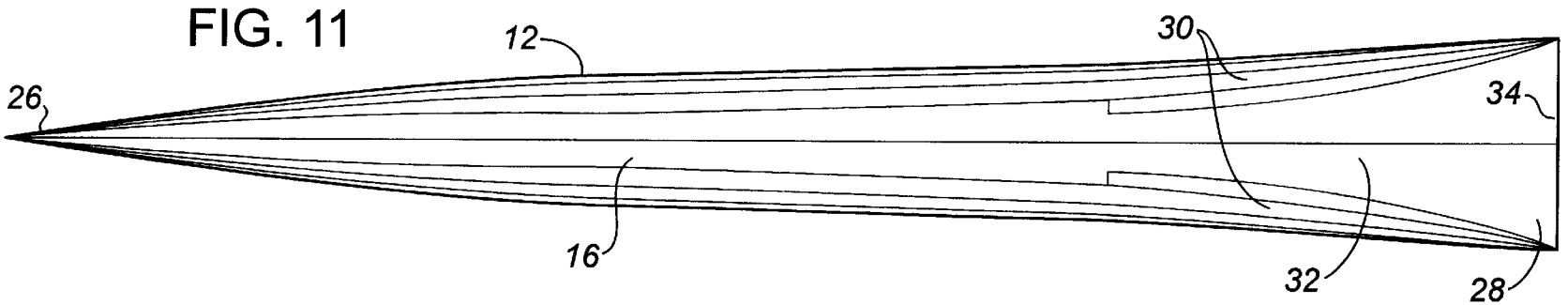
FIG. 11 is a bottom plan view of the boat illustrated in FIG. 10.

Referring to FIG. 10, boat 10 can be configured for two paddling positions with a forward paddling position 38 and a rearward paddling position 40. Accordingly two access openings 20 are provided in top surface cover 18 along with three storage access openings 24. Body of boat 10 when configured for two paddling positions is sufficiently narrow at both forward paddling position 38 and rearward paddling position 40 to provide a comfortable paddling widthe. Bow 26 extends forward and converges to become progressively narrower from forward paddling position 38 and stern 28 extends rearward and diverges to become progressively wider from rearward paddling position 40, thereby increasing lateral stability. Referring to FIG. 11, stern 28 has two hulls 30 that are positioned rearward of rearward paddling position 40 and are separated by connecting surface 32. Connecting surface 40 extends from rearward paddling position 40 upward to upper remote end 34 that is out of the water at stern 28, thereby reducing drag. With reference to FIGS. 4 through 9, end elevation views are shown at intervals along hull 30, as along section line 4—4, 5—5, 6—6, 7—7, 8—8, and 9—9 respectively of FIG. 10.

It will further be apparent to one skilled in the art that the boat, as described above, can be made into either a canoe or kayak.

The use and operation of boat 10 will now be described with reference to FIGS. 1 through 12. The construction of a boat 10 such as a canoe or a kayak always requires a compromise between maximum width for lateral stability and minimum width for paddling ease. Stability comes from width. However, as width increases the boat becomes harder to paddle and moves slower through the water. Boat 10 is designed to separate the lateral stability factors relating to width from the paddling comfort factors of width. It does this by moving the greatest width portion of boat 10 to stern 28 and away from the paddling position 14. The width of boat 10 at paddling position 14 need only be determined by considerations related to paddling comfort and ease. Normally increasing the width of boat 10 at stern 28 would slow boat 10 down. With boat 10, hulls 30 engage water 36 to provide substantially increased lateral stability without reducing the ease with which boat 10 can be propelled forward. Connecting surface 32, which is positioned out of water 36 at remote end 34, provides little if any drag.

It will be apparent to one skilled in the art that other modifications may also be made to the illustrated embodiment without departing from the spirit and scope of the invention as hereinafter defined in the claims.

The embodiments of the invention in which an exclusive property or privilege is claimed are defined as follows:

1. A boat, comprising:

a body having at least one paddling position, the body being sufficiently narrow at the at least one paddling position to provide a comfortable paddling width;

a bow extending forwardly and converging to become progressively narrower from the at least one paddling position;

a stern extending rearwardly and diverging to become progressively wider from the at least one paddling position, thereby increasing lateral stability, the stern having two hulls positioned rearward of the at least one paddling position and separated by a connecting surface, the connecting surface extending rearwardly and upwardly from the at least one paddling position to an upper remote end that is out of the water at the stern, thereby reducing drag.

2. The boat as defined in claim 1, wherein the body is that of a kayak.

3. The boat as defined in claim 1, wherein the body is that of a canoe.

4. A boat, comprising:

a body having a single paddling position, the body being sufficiently narrow at the single paddling position to provide a comfortable paddling width;

a bow extending forwardly and converging to become progressively narrower from the single paddling position;

a stern extending rearwardly and diverging to become progressively wider from the single paddling position, thereby increasing lateral stability, the stern having two hulls positioned rearward of the single paddling position and separated by a connecting surface, the connecting surface extending rearwardly and upwardly from the single paddling position to an upper remote end that is out of the water at the stern, thereby reducing drag.

5. A boat, comprising:

a body having a forward paddling position and a rearward paddling position, the body being sufficiently narrow at both forward paddling position and the rearward paddling position to provide a comfortable paddling width;

a bow extending forwardly and converging to become progressively narrower from the forward paddling position;

a stern extending rearwardly and diverging to become progressively wider from the rearward paddling position, thereby increasing lateral stability, the stern having two hulls positioned rearward of the rearward paddling position and separated by a connecting surface, the connecting surface extending rearwardly and upwardly from the rearward paddling position to an upper remote end that is out of the water at the stern, thereby reducing drag.

* * * * *